US010074934B1

(12) United States Patent
Hashiguchi

(10) Patent No.: US 10,074,934 B1
(45) Date of Patent: Sep. 11, 2018

(54) CONNECTOR ASSEMBLY

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/854,881

(22) Filed: Dec. 27, 2017

(30) Foreign Application Priority Data

Feb. 28, 2017 (JP) ..... 2017-036388

(51) Int. Cl.
*H01R 4/38* (2006.01)
*H01R 13/627* (2006.01)
*H01R 13/631* (2006.01)

(52) U.S. Cl.
CPC ..... *H01R 13/6272* (2013.01); *H01R 13/631* (2013.01)

(58) Field of Classification Search
CPC ..... H01R 13/622; H01R 13/5219; H01R 13/595; H01R 13/5812; H01R 13/625
USPC ..... 439/321, 320, 469, 470, 318, 312, 313
See application file for complete search history.

(56) References Cited

U.S. PATENT DOCUMENTS 5,932,841 A * 8/1999 Matsumoto ..... H01R 13/6593 174/359
6,838,612 B2 * 1/2005 Krug ..... H01R 35/04 174/21 JR
7,131,858 B1 * 11/2006 Zerebilov ..... H01R 9/0518 439/446
7,201,603 B1 * 4/2007 Finona ..... H01R 13/562 174/86
7,766,682 B1 * 8/2010 Larkin ..... H01R 13/567 439/281
9,515,415 B1 * 12/2016 Lyon ..... H01R 13/5812
2005/0173395 A1 * 8/2005 Haussner ..... G01L 23/22 219/270

FOREIGN PATENT DOCUMENTS

JP 2015-088256 A 5/2015

* cited by examiner

*Primary Examiner* — Phuong Chi T Nguyen
(74) *Attorney, Agent, or Firm* — Collard & Roe, P.C.

(57) ABSTRACT

A connector assembly comprises a first connector and a second connector. One of the first connector and the second connector is a cable connector which is configured to be connected with a cable. The first connector comprises a plurality of first engagement portions. The second connector comprises at least one support portion and at least one second engagement portion. under a mated state where the first connector and the second connector are mated with each other, the first engagement portions are divided into to a first group and a second group and each of the at least one second engagement portion faces one of the first engagement portion(s) of the first group in a front-rear direction while each of the first engagement portion(s) of the second group does not face any of the at least one second engagement portion in the front-rear direction.

13 Claims, 6 Drawing Sheets

CONNECTOR ASSEMBLY

CROSS REFERENCE TO RELATED APPLICATIONS

This application is based on and claims priority under 35 U.S.C. § 119 to Japanese Patent Application No. JP2017-036388 filed Feb. 28, 2017, the contents of which are incorporated herein in their entireties by reference.

BACKGROUND OF THE INVENTION

This invention relates to a connector assembly comprising two connectors which are mateable with each other, especially to a connector assembly wherein one of the two connectors is a cable connector which is configured to be connected with a cable.

As shown in FIG. 12, a connector unit 900 of JPA 2015-88256 (Patent Document 1) has a connector 910 and a cover 930. The connector 910 includes a housing 920. The cover 930 is attached to the housing 920. The housing 920 is provided with four connector-side engagement portions 925. The cover 930 is provided with four cover-side engagement portions 935. The cover-side engagement portions 935 are coupled with the connector-side engagement portions 925, respectively, so that the cover 930 can be attached to the housing 920 in the illustrated attitude. Additionally, in a similar manner as described above, the cover 930 can also be attached to the housing 920 in an attitude rotated 90 degrees about a mating direction along which the connector 910 is mateable with a mating connector 950. Accordingly, a direction, in which a cable (not shown) extends, is selectable from a plurality of directions each of which is different from the mating direction of the connector 910 with the mating connector 950.

SUMMARY OF THE INVENTION

It is an object of the present invention to provide a connector assembly having a structure which can easily adjust an extending direction of a cable when two connectors are mated with each other.

One aspect of the present invention provides a connector assembly comprising a first connector and a second connector. The first connector has a first virtual axis. The second connector has a second virtual axis. The first connector and the second connector are mateable with each other along a front-rear direction so that the first virtual axis and the second virtual axis are aligned with each other. One of the first connector and the second connector is a cable connector which is configured to be connected with a cable. The cable connector has a cable holding portion which holds a part of the cable so that the part of the cable extends in a direction different from the front-rear direction. The first connector comprises a plurality of first engagement portions. The second connector comprises at least one support portion and at least one second engagement portion. The support portion supports the at least one second engagement portion so that the at least one second engagement portion is movable in a direction intersecting with the front-rear direction. Under a mated state where the first connector and the second connector are mated with each other, the first engagement portions are divided into to a first group and a second group and each of the at least one second engagement portion faces one of the first engagement portion(s) of the first group in the front-rear direction while each of the first engagement portion(s) of the second group does not face any of the at least one second engagement portion in the front-rear direction.

In the connector unit of Patent Document 1, a relation between the mating direction of the connector with the mating connector and an extending direction, or a direction in which the cable finally extends, depends on only how to attach the cover to the connector. Specifically, the mating connector has no structure to define the relation between the mating direction and the extending direction. Accordingly, in the connector unit of Patent Document 1, it is necessary that the relation between the mating direction and the extending direction is known before the mating of the connector with the mating connector and that the cover is attached to the housing on the basis of the known relation.

On the contrary, the connector assembly according to the present invention is provided with a structure which defines a relation between an extending direction, in which the cable extends, and a mating direction, along which the first connector and the second connector are mateable with each other, when the first connector and the second connector are mated with each other. Accordingly, it is not necessary to know the relation between the extending direction and the mating direction before the mating of the first connector with the second connector. Thus, it can be easily achieved that the first connector and the second connector are mated with each other while the cable extends in an intended direction.

When the first connector and the second connector are mated with each other, the second engagement portion corresponds to the first engagement portion(s) of the first group, or one(s) of the first engagement portions which are selected from the plurality of the first engagement portions. Accordingly, a rotation angle of the second connector relative to the first connector can be finely changed. In addition, under the mated state where the first connector and the second connector are mated with each other, the connector assembly has the first engagement portions of the second group, or a remaining one(s) of the first engagement portions which do not correspond to the second engagement portion. In other words, the connector assembly is configured that the remaining one(s) of the first engagement portions are spares. Accordingly, the second connector can have a reduced number of support portions each of which supports the second engagement portion. Thus, an interface structure of the second connector can be prevented from being complicated while having certain strength. Consequently, according to the present invention, the rotation angle of the second connector relative to the first connector can be finely adjusted while the interface structure of the second connector has simple structure and certain strength.

Figure 1:
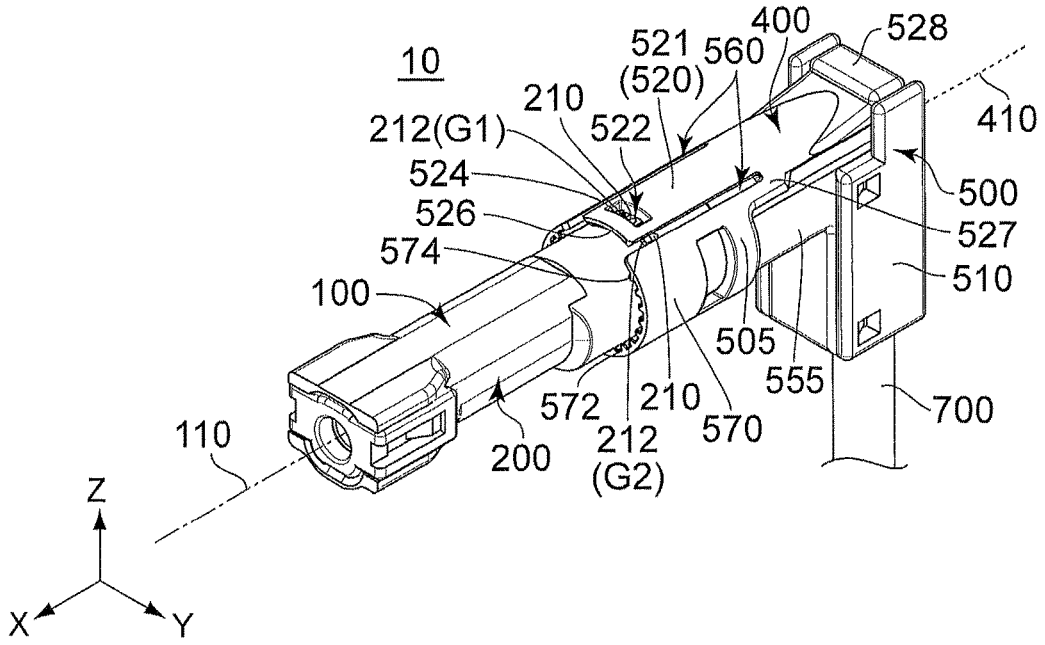
FIG. 1 is a perspective view showing a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIGS. 1 to 9, a connector assembly 10 according to a first embodiment of the present invention comprises a first connector 100 and a second connector 400.

As shown in FIGS. 1 to 4, the first connector 100 of the present embodiment has a first virtual axis 110, while the second connector 400 of the present embodiment has a second virtual axis 410. In the present embodiment, each of the first virtual axis 110 and the second virtual axis 410 is parallel to a front-rear direction. In the present embodiment, the front-rear direction is an X-direction. The first connector 100 and the second connector 400 are mateable with each other along the front-rear direction so that the first virtual axis 110 and the second virtual axis 410 are aligned with each other. In the present embodiment, the second connector 400 is a cable connector which is configured to be connected with a cable 700. However, the present invention is not limited thereto. It is sufficient that one of the first connector and the second connector is a cable connector which is configured to be connected with a cable.

Figure 6:
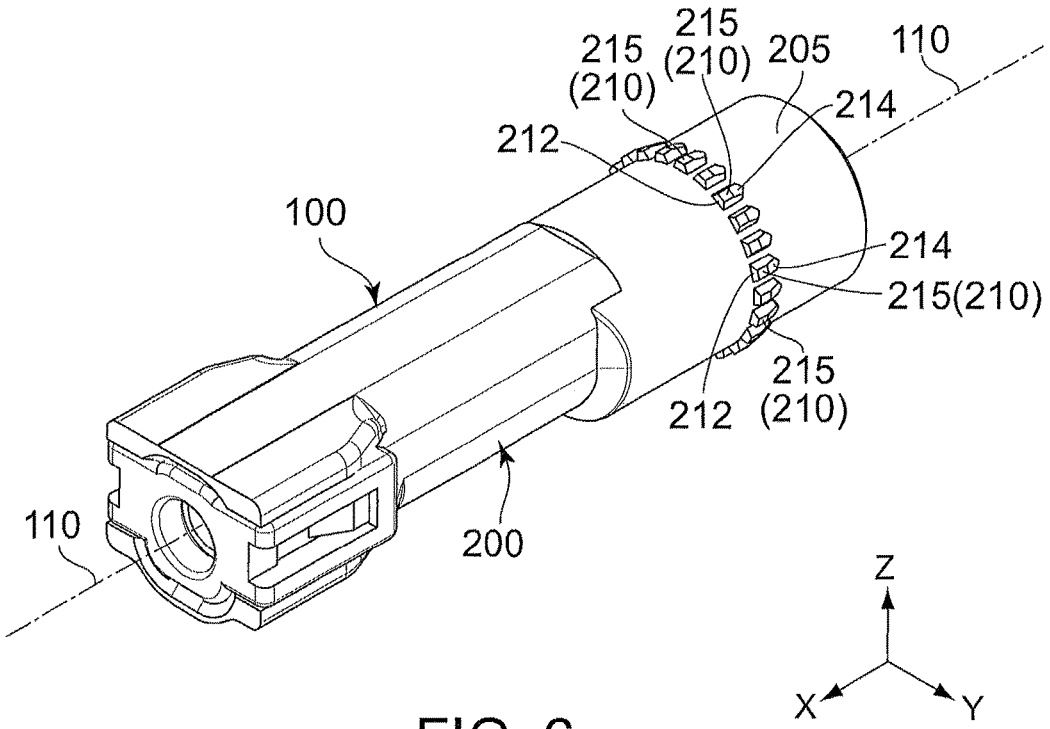
FIG. 6 is a perspective view showing a first connector which is included in the connector assembly of FIG. 1.
Figure 7:
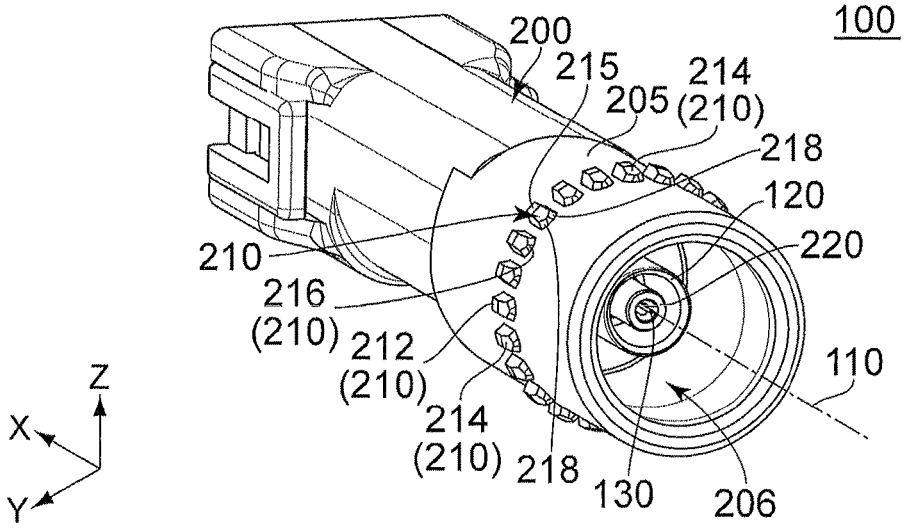
FIG. 7 is another perspective view showing the first connector of FIG. 6.

As shown in FIGS. 6 and 7, the first connector 100 of the present embodiment comprises a first holding member 200, a first main terminal 120 and a first sub terminal 130.

As shown in FIGS. 6 and 7, the first holding member 200 of the present embodiment has a first mating portion 205 and a plurality of first engagement portions 212. The first mating portion 205 is positioned at a rear end of the first holding member 200 in the front-rear direction. In the present embodiment, rearward is a negative X-direction. The first mating portion 205 has a substantially cylindrical shape when viewed from a rear of the first holding member 200. A center axis of the substantially cylindrical shape of the first mating portion 205 is aligned with the first virtual axis 110. An outer circumferential surface of the substantially cylindrical shape of the first mating portion 205 is provided with a plurality of protrusions 210. In other words, the first connector 100 of the present embodiment has the plurality of the protrusions 210. Each of the protrusions 210 protrudes in a direction perpendicular to the front-rear direction. The direction perpendicular to the front-rear direction is hereafter referred to as "perpendicular direction". Specifically, each of the protrusions 210 protrudes outward in a radial direction of the first virtual axis 110. In addition, each of the protrusions 210 has a front surface 212 facing forward in the front-rear direction. In detail, each of the protrusions 210 has the front surface 212, an outer surface 215, a slope surface 214, a rear surface 216 and rear inclined surfaces 218. The front surface 212 is positioned at a front side of the protrusion 210 in the front-rear direction. The outer surface 215 is positioned at an outer side of the protrusion 210 in the perpendicular direction. The slope surface 214 is positioned rearward of the outer surface 215 in the front-rear direction. The rear surface 216 is positioned rearward of the slope surface 214 in the front-rear direction. The rear inclined surfaces 218 are positioned at opposite sides, respectively, of the rear surface 216 in a circumferential direction of the first virtual axis 110. In the present embodiment, forward is a positive X-direction. The front surface 212 is a plane perpendicular to the front-rear direction. The outer surface 215 is a plane perpendicular to the perpendicular direction. The slope surface 214 is a plane oblique to both the front-rear direction and the perpendicular direction. In detail, the slope surface 214 is sloped rearward in the front-rear direction and inward in the perpendicular direction. In other words, the slope surface 214 is sloped so that the protrusion 210 is increased in height toward a front end of the slope surface 214. The rear surface 216 is a plane perpendicular to the front-rear direction. Each of the rear inclined surfaces 218 is a plane oblique to both the front-rear direction and the circumferential direction of the first virtual axis 110. The front surface 212 of the protrusion 210 functions as the first engagement portion 212. The first engagement portions 212 are arranged at regular intervals in the circumferential direction of the first virtual axis 110.

As shown in FIG. 7, the first main terminal 120, a first guard portion 220 and the first sub terminal 130 are provided inside the substantially cylindrical shape of the first mating portion 205. The first main terminal 120 has a substantially cylindrical shape extending in the front-rear direction. The first guard portion 220 has a substantially cylindrical shape extending in the front-rear direction. The first sub terminal 130 has a needle shape extending in the front-rear direction. A center axis of the substantially cylindrical shape of the first main terminal 120, a center axis of the substantially cylindrical shape of the first guard portion 220 and a center axis of the needle shape of the first sub terminal 130 are aligned with each other. Each of the center axis of the substantially cylindrical shape of the first main terminal 120, the center axis of the substantially cylindrical shape of the first guard portion 220 and the center axis of the needle shape of the first sub terminal 130 is aligned with the first virtual axis 110. The first main terminal 120 surrounds the first guard portion 220 in a plane perpendicular to the front-rear direction. The first guard portion 220 surrounds the first sub terminal 130 in the plane perpendicular to the front-rear direction.

Figure 5:
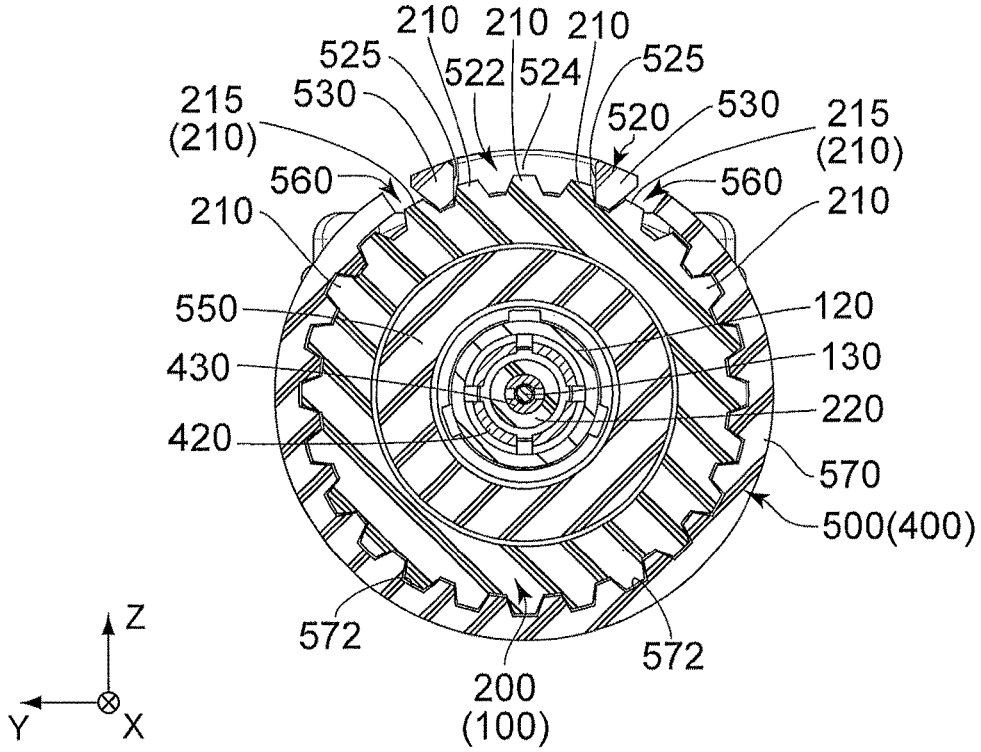
FIG. 5 is a cross-sectional view showing the connector assembly of FIG. 3, taken along line A-A.
Figure 8:
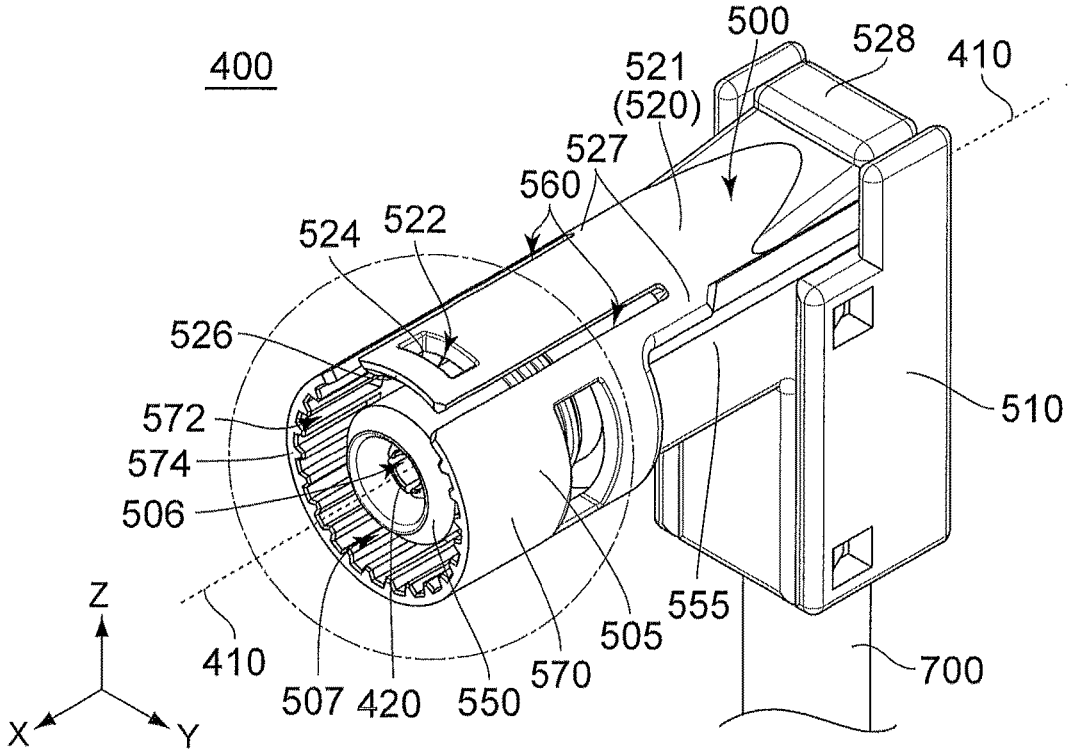
FIG. 8 is a perspective view showing a second connector which is included in the connector assembly of FIG. 1.
Figure 9:
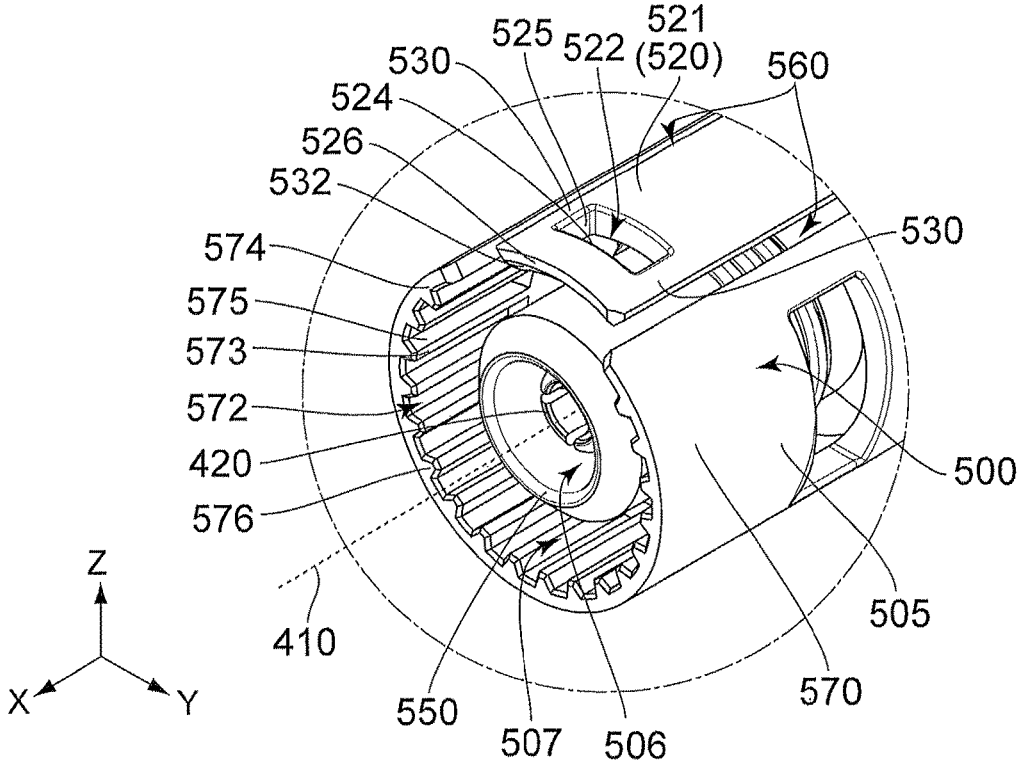
FIG. 9 is a partially enlarged, perspective view showing the second connector of FIG. 8.

As shown in FIGS. 5, 8 and 9, the second connector 400 of the present embodiment is the cable connector. Specifically, the second connector 400 comprises a second holding member 500, a second main terminal 420 and a second sub terminal 430.

As shown in FIGS. 5, 8 and 9, the second holding member 500 of the present embodiment has a second mating portion 505, a cable holding portion 510, a support portion 520, a second engagement portion 524, a coupling portion 555, a cover portion 570 and two slits 560. Each of the slits 560 extends in the front-rear direction. However, the present invention is not limited thereto. It is sufficient that the second connector comprises at least one support portion and at least one second engagement portion. In addition, the second connector may have at least two slits each of which extends in the front-rear direction.

As shown in FIGS. 5, 8 and 9, the second mating portion 505 of the present embodiment is positioned at a front end of the second holding member 500 in the front-rear direction. The second mating portion 505 has a semicylindrical shape extending in the front-rear direction. A center axis of the semicylindrical shape of the second mating portion 505 is aligned with the second virtual axis 410. A second guard portion 550, the second main terminal 420 and the second sub terminal 430 are provided inside the semicylindrical shape of the second mating portion 505. The second guard portion 550 of the present embodiment has a substantially cylindrical shape extending in the front-rear direction. The second main terminal 420 has a substantially cylindrical shape extending in the front-rear direction. The second main terminal 420 has four cuts each of which extends in the front-rear direction. The four cuts of the second main terminal 420 are arranged at regular intervals in its circumferential direction. As described later, the second main terminal 420 is connected with the first main terminal 120 of the first connector 100 when the first connector 100 and the second connector 400 are mated with each other. The second sub terminal 430 has a substantially cylindrical shape extending in the front-rear direction. The second sub terminal 430 has two cuts each of which extends in the front-rear direction. The two cuts of the second sub terminal 430 are arranged at regular intervals in its circumferential direction. As described later, the second sub terminal 430 is connected with the first sub terminal 130 of the first connector 100 when the first connector 100 and the second connector 400 are mated with each other. As understood from FIG. 5, center axes of the substantially cylindrical shapes of the second guard portion 550, the second main terminal 420 and the second sub terminal 430 are aligned with each other. Each of the center axes of the substantially cylindrical shapes of the second guard portion 550, the second main terminal 420 and the second sub terminal 430 is aligned with the second virtual axis 410. The second guard portion 550 surrounds the second main terminal 420 in the plane perpendicular to the front-rear direction. The second main terminal 420 surrounds the second sub terminal 430 in the plane perpendicular to the front-rear direction.

As shown in FIG. 8, the cable holding portion 510 of the present embodiment holds a part of the cable 700 so that the part of the cable 700 extends in a direction different from the front-rear direction. Specifically, in FIG. 8, the cable 700 is held by the cable holding portion 510 so as to extend downward in an up-down direction. In the present embodiment, the up-down direction is a Z-direction, and downward is a negative Z-direction.

As shown in FIGS. 8 and 9, the support portion 520 of the present embodiment is positioned at an upper part of the second holding member 500 in the up-down direction. In the present embodiment, upward is a positive Z-direction. The support portion 520 of the present embodiment has an arc-shape when viewed from a front of the second holding member 500 in the front-rear direction. More specifically, a structure, which is formed by combining the support portion 520 and the second mating portion 505 of the present embodiment, has a substantially cylindrical shape extending in the front-rear direction. The support portion 520 of the present embodiment has a plate-like portion 521, fulcrum portions 527 and a release portion 528.

As shown in FIGS. 5, 8 and 9, the plate-like portion 521 of the present embodiment has a curved plate-like shape extending in the front-rear direction. The plate-like portion 521 is provided with a slope portion 532, a recess 522 and two beam portions 530. The plate-like portion 521 has a front end 526 in the front-rear direction. However, the present invention is not limited thereto. The second connector may have at least one recess.

As shown in FIGS. 8 and 9, the slope portion 532 of the present embodiment is oblique to both the front-rear direction and the perpendicular direction. The slope portion 532 is positioned in the vicinity of the front end 526 of the plate-like portion 521 in the front-rear direction. Specifically, the slope portion 532 of the present embodiment is sloped so that the plate-like portion 521 is increased in thickness toward a rear end of the slope portion 532.

As shown in FIGS. 8 and 9, the recess 522 of the present embodiment is positioned rearward of the slope portion 532 in the front-rear direction. The recess 522 pierces the plate-like portion 521 of the support portion 520 in a radial direction of the second virtual axis 410. The recess 522 is partially defined by a front inner wall 524. Specifically, the recess 522 has the front inner wall 524 and two side walls 525. The front inner wall 524 faces rearward in the front-rear direction. The front inner wall 524 is a plane perpendicular to the front-rear direction. The front inner wall 524 of the recess 522 functions as the second engagement portion 524. Each of the side walls 525 is a plane perpendicular to a width direction which is perpendicular to both the front-rear direction and the up-down direction. In the present embodiment, the width direction is a Y-direction.

As shown in FIG. 5, each of the beam portions 530 protrudes inward in the perpendicular direction. Specifically, each of the beam portions 530 protrudes inward in the radial direction of the second virtual axis 410. Each of the beam portions 530 is positioned outside the recess 522 in a circumferential direction of the second virtual axis 410. In other words, the side walls 525 of the recess 522 correspond to the beam portions 530, respectively, and each of the side walls 525 of the recess 522 is an inner surface of the beam portion 530 corresponding thereto in the circumferential direction of the second virtual axis 410.

As shown in FIGS. 8 and 9, each of the fulcrum portions 527 is positioned around a middle of the support portion 520 in the front-rear direction. The fulcrum portions 527 extend substantially forward from side ends, respectively, of the plate-like portion 521 in the circumferential direction of the second virtual axis 410. Each of the fulcrum portions 527 is coupled with an upper end of the second mating portion 505 which is positioned rearward thereof. In detail, the support portion 520 of the present embodiment is coupled with a part of the second holding member 500, which is other than the support portion 520, only by the fulcrum portions 527. Each of the fulcrum portions 527 is resiliently deformable.

As shown in FIGS. 8 and 9, the release portion 528 of the present embodiment is formed on a rear end of the support portion 520 in the front-rear direction. The release portion 528 protrudes upward in the up-down direction. As described above, the support portion 520 of the present embodiment has the fulcrum portions 527 each of which is positioned around the middle of the support portion 520 in the front-rear direction, and the support portion 520 is coupled with the part of the second holding member 500, which is other than the support portion 520, only by the fulcrum portions 527. Accordingly, when the release portion 528 is pressed downward, the support portion 520 is movable in a seesaw manner with the fulcrum portions 527 acting as fulcrums. Specifically, when the release portion 528 is pressed downward, the release portion 528 is moved downward while the second engagement portion 524 of the recess 522 is moved upward. When the release portion 528 is unpressed, the release portion 528 and the second engagement portion 524 of the recess 522 return to their initial positions. In other words, the support portion 520 of the present embodiment supports the second engagement portion 524 so that the second engagement portion 524 is movable in the up-down direction. However, the present invention is not limited thereto. It is sufficient that the support portion supports at least one second engagement portion so that the at least one second engagement portion is movable in a direction intersecting with the front-rear direction. For example, the second connector may be configured as follows: the support portion is distinct and separated from the second holding member; the support portion is provided with pivots instead of the fulcrum portions; each of the pivots protrudes outward in the width direction; the second holding member is provided with bearings which are fitted on the pivots; the second connector is provided with a torsion spring between the support portion and the second holding member; and thereby the second engagement portion is movable in the up-down direction. In addition, if the second connector can comprise another release means for releasing the mating of the first connector with the second connector, the second engagement portion may be configured so as to be movable in the up-down direction by utilizing only resilient deformation of the support portion.

As shown in FIGS. 8 and 9, the coupling portion 555 of the present embodiment has a substantially rectangular tube shape extending in the front-rear direction. The coupling portion 555 is positioned between the second mating portion 505 and the cable holding portion 510 in the front-rear direction. The coupling portion 555 couples a rear end of the second mating portion 505 with a front end of the cable holding portion 510. The coupling portion 555 is positioned below the support portion 520 in the up-down direction.

As shown in FIGS. 8 and 9, the cover portion 570 of the present embodiment forms a front part of the second mating portion 505. Specifically, the cover portion 570 has a front end 574 in the front-rear direction. The front end 574 of the cover portion 570 is positioned forward beyond the front end 526 of the support portion 520 in the front-rear direction. The cover portion 570 of the present embodiment is formed with a plurality of ditches 572 each extending in the front-rear direction. The ditches 572 are arranged at regular intervals in the circumferential direction of the second virtual axis 410. As understood from FIGS. 5 and 6, in the circumferential direction of the second virtual axis 410, an interval between the first engagement portions 212 and an interval between the ditches 572 are same as each other. However, the present invention is not limited thereto. The cover portion may be formed with at least one ditch extending in the front-rear direction, or may be formed with no ditch.

As shown in FIGS. 8 and 9, each of the ditches 572 of the present embodiment extends to reach the front end 574 of the cover portion 570 in the front-rear direction. In other words, each of the ditches 572 of the present embodiment is opened forward in the front-rear direction. The cover portion 570 is formed with mounting portions 573 each of which is arranged between the adjacent ditches 572 in the circumferential direction of the second virtual axis 410. Each of the mounting portions 573 protrudes inward in the perpendicular direction. Specifically, each of the mounting portions 573 protrudes inward in the radial direction of the second virtual axis 410. Each of the mounting portions 573 has two slope surfaces 575 and a front surface 576. Each of the slope surfaces 575 is an outer surface of the mounting portion 573 in the circumferential direction of the second virtual axis 410. The front surface 576 is a plane perpendicular to the front-rear direction. The front surface 576 is positioned at a front end of the mounting portion 573 in the front-rear direction. Specifically, the front surface 576 of the mounting portion 573 is also the front end 574 of the cover portion 570.

As shown in FIGS. 5, 8 and 9, each of the slits 560 of the present embodiment is interposed between the cover portion 570 and the support portion 520 in the circumferential direction of the second virtual axis 410. In detail, the beam portions 530 correspond to the slits 560, respectively, and each of the beam portions 530 is positioned between the slit 560 corresponding thereto and the recess 522 in the circumferential direction of the second virtual axis 410. Each of the slits 560 can accommodate one of the protrusions 210 of the first connector 100. However, the present invention is not limited thereto. Each of the slits may be able to accommodate one or more of the protrusions.

An operation of mating the first connector 100 with the second connector 400 is described in detail hereinafter.

Referring to FIGS. 1 to 3 and 5 to 9, in the plane perpendicular to the front-rear direction, the first connector 100 and the second connector 400 are positioned so that the first virtual axis 110 of the first connector 100 and the second virtual axis 410 of the second connector 400 are aligned with each other. Next, the first connector 100 and the second connector 400 are moved to approach each other so that the first mating portion 205 of the first connector 100 and the second mating portion 505 of the second connector 400 are closer to each other in the front-rear direction.

Meanwhile, in a case where the protrusion 210 of the first connector 100 is misaligned with respect to the ditch 572 of the cover portion 570 of the second connector 400 in the circumferential directions of the first virtual axis 110 and the second virtual axis 410, the rear surface 216 of the protrusion 210 of the first connector 100 is brought into abutment with the front surface 576 of the mounting portion 573 of the second connector 400. However, as the first connector 100 or the second connector 400 is then slightly rotated in the circumferential directions, the rear inclined surface 218 of the protrusion 210 of the first connector 100 reaches a relative position same as that of the slope surface 575 of the mounting portion 573 of the cover portion 570 of the second connector 400 in the circumferential directions. After that, the first connector 100 and the second connector 400 are further moved to approach each other while keeping the relative position in the circumferential directions, so that the protrusion 210, which faces the ditch 572 of the cover portion 570 of the second connector 400, is guided so as to be accommodated into the ditch 572. At that time, the protrusions 210 are divided into a first set and a second set. Specifically, the protrusions 210 of the first set face the ditches 572, respectively, while each of the protrusions 210 of the second set does not face any of the ditches 572. In detail, the protrusions 210 of the second set are divided into two of the protrusions 210, which are closest to the cover portion 570 in the circumferential directions, and remaining three of the protrusions 210. Specifically, the two protrusions 210 of the second set are positioned in front of the slits 560, respectively, and the slope surface 214 of each of the remaining three protrusions 210 of the second set is brought into abutment with the slope portion 532 of the support portion 520 of the second connector 400.

As described above, the front end 574 of the cover portion 570 of the present embodiment is positioned forward beyond the front end 526 of the support portion 520 in the front-rear direction. Accordingly, under the aforementioned state where the slope surface 214 of each of the remaining three protrusions 210 of the second set of the first connector 100 is brought into abutment with the slope portion 532 of the support portion 520 of the second connector 400, each of the ditches 572 of the cover portion 570 of the second connector 400 accommodates the protrusion 210 of the first set corresponding thereto. Specifically, at that time, the first connector 100 and the second connector 400 are in a state where the first connector 100 and the second connector 400 are fixedly positioned so as not to be relatively rotated in the circumferential directions.

When the first connector 100 and the second connector 400 are still further moved to approach each other in the front-rear direction, the slope surfaces 214 of the remaining three protrusions 210 of the second set of the first connector 100 move the slope portion 532 of the support portion 520 of the second connector 400 in a direction intersecting with the front-rear direction. Specifically, each of the fulcrum portions 527 of the support portion 520 is deformed, so that the recess 522 of the support portion 520 is moved outward in the perpendicular direction. In this state, when the first connector 100 and the second connector 400 are yet further moved to approach each other in the front-rear direction so that each of the first engagement portions 212 of the remaining three protrusions 210 of the second set of the first connector 100 reaches a relative position same as that of the second engagement portion 524 of the recess 522 of the second connector 400 in the front-rear direction, the fulcrum portions 527 of the support portion 520 restore their original shapes while the recess 522 returns to its initial position in the perpendicular direction. In other words, the first connector 100 and the second connector 400 are in a mated state where the first connector 100 and the second connector 400 are mated with each other. Meanwhile, each of the two protrusions 210 of the second set, which was positioned in front of the slit 560 corresponding thereto, is accommodated in the slit 560 corresponding thereto. Also, meanwhile, each of the beam portions 530 is, at least in part, positioned between adjacent two of the protrusions 210 in the circumferential direction of the first virtual axis 110. Specifically, each of the beam portions 530 does not ride over any of the protrusions 210. In other words, each of the beam portions 530 is brought into contact with none of the first engagement portion 212, the outer surface 215 and the slope surface 214 (see FIG. 6) of any of the protrusions 210. Accordingly, under the aforementioned mated state, the support portion 520 is prevented from riding over the protrusion 210 to be lifted up.

Figure 2:
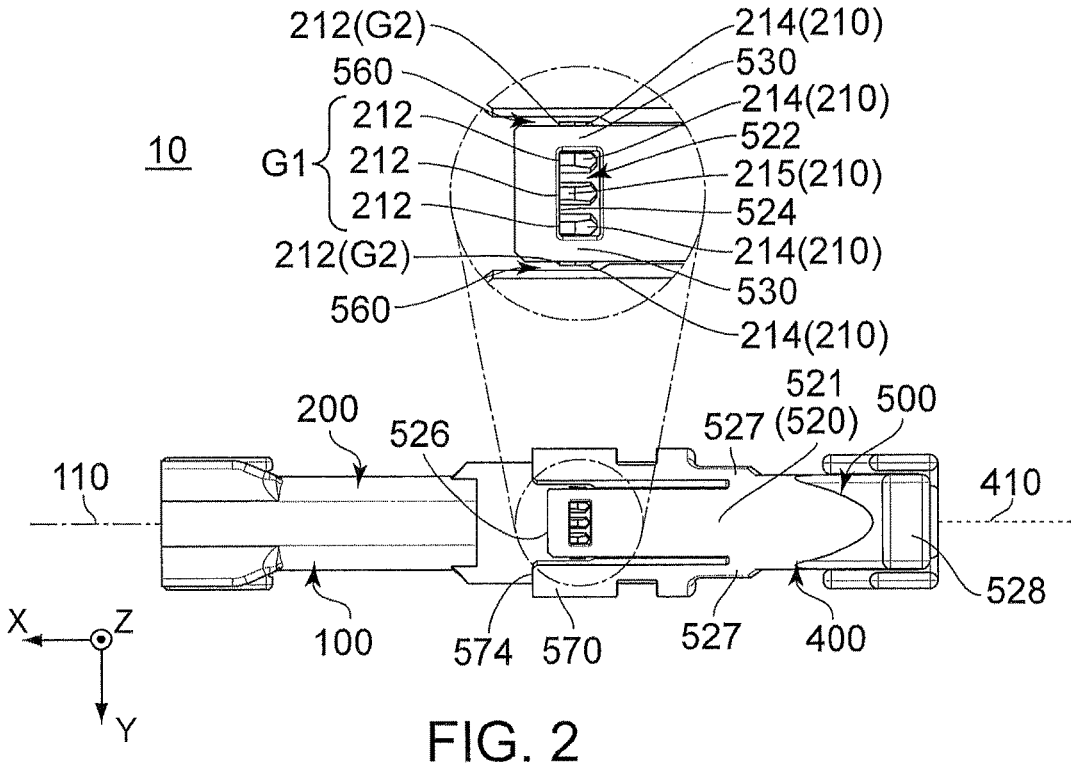
FIG. 2 is a top view showing the connector assembly of FIG. 1, wherein a part of the connector assembly is illustrated enlarged.
Figure 3:
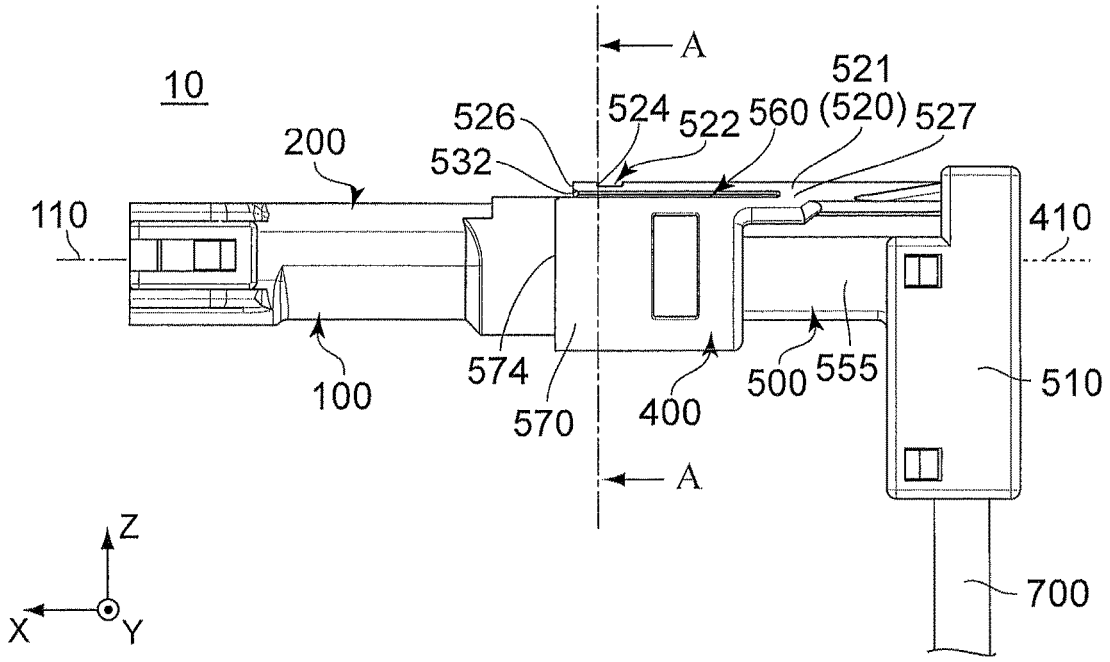
FIG. 3 is a side view showing the connector assembly of FIG. 1.

As shown in FIGS. 1 and 2, the recess 522 of the support portion 520 of the second connector 400 receives the remaining three protrusions 210 of the second set of the first mating portion 205 of the first connector 100 under the aforementioned mated state. Since the recess 522 of the present embodiment pierces the support portion 520 in the radial direction of the second virtual axis 410, an engagement state of the first engagement portions 212 with the second engagement portion 524 can be visually inspected.

As understood from FIGS. 1, 2 and 5 to 9, the single second engagement portion 524 faces a plurality of the first engagement portions 212 in the front-rear direction under the aforementioned mated state. Specifically, under the aforementioned mated state, each of the first engagement portions 212 of the remaining three protrusions 210 of the second set of the first connector 100 faces the second engagement portion 524 of the recess 522 of the support portion 520 of the second connector 400 in the front-rear direction while each of the first engagement portions 212 of the protrusions 210, which are other than the remaining three protrusions 210 of the second set, does not face the second engagement portion 524 of the support portion 520 of the second connector 400 in the front-rear direction.

In detail, as understood from FIGS. 1, 2 and 5 to 9, under the aforementioned mated state, the first engagement portions 212 are divided into a first group G1 and a second group G2. The first group G1 includes the first engagement portions 212 of the remaining three protrusions 210 of the second set, and the second group G2 includes the first engagement portions 212 of the protrusions 210 which are other than the remaining three protrusions 210 of the second set. Specifically, under the mated state, the second engagement portion 524 faces each of the first engagement portions 212 of the first group G1 in the front-rear direction while each of the first engagement portions 212 of the second group G2 does not face the second engagement portion 524 in the front-rear direction. Under the aforementioned mated state, the front surfaces 212 of ones of the protrusions 210 function as the first engagement portions 212 of the second group G2 and at least one of the ones of the protrusions 210 faces the cover portion 570 in the radial direction of the first virtual axis 110. More specifically, under the aforementioned mated state, the ones of the protrusions 210 are accommodated in the slits 560 or face the cover portion 570 in the radial direction of the first virtual axis 110. In addition, at least some of the first engagement portions 212 of the second group G2 are accommodated in the ditches 572, respectively, under the aforementioned mated state. More specifically, under the aforementioned mated state, the first engagement portions 212 of the second group G2 are accommodated in the ditches 572 except for the first engagement portions 212 of the second group G2 which are accommodated in the slits 560, respectively.

Furthermore, as understood from FIGS. 5 and 7 to 9, the first mating portion 205 of the first connector 100 is accommodated in a first engagement portion accommodating portion 507 of the second connector 400 under the aforementioned mated state. Meanwhile, the second guard portion 550 of the second connector 400 is accommodated in a second guard portion accommodating portion 206, which is positioned within the first mating portion 205 of the first connector 100, while the first guard portion 220 of the first connector 100 is accommodated in a first guard portion accommodating portion 506 of the second connector 400. Also, meanwhile, the first main terminal 120 of the first connector 100 is brought into contact with the second main terminal 420 of the second connector 400 in the plane perpendicular to the front-rear direction from outside the second main terminal 420 while the first sub terminal 130 of the first connector 100 is brought into contact with the second sub terminal 430 of the second connector 400 in the plane perpendicular to the front-rear direction from inside the second sub terminal 430. Thus, the first main terminal 120 of the first connector 100 and the second main terminal 420 of the second connector 400 are connected with each other while the first sub terminal 130 of the first connector 100 and the second sub terminal 430 of the second connector 400 are connected with each other.

Figure 4:
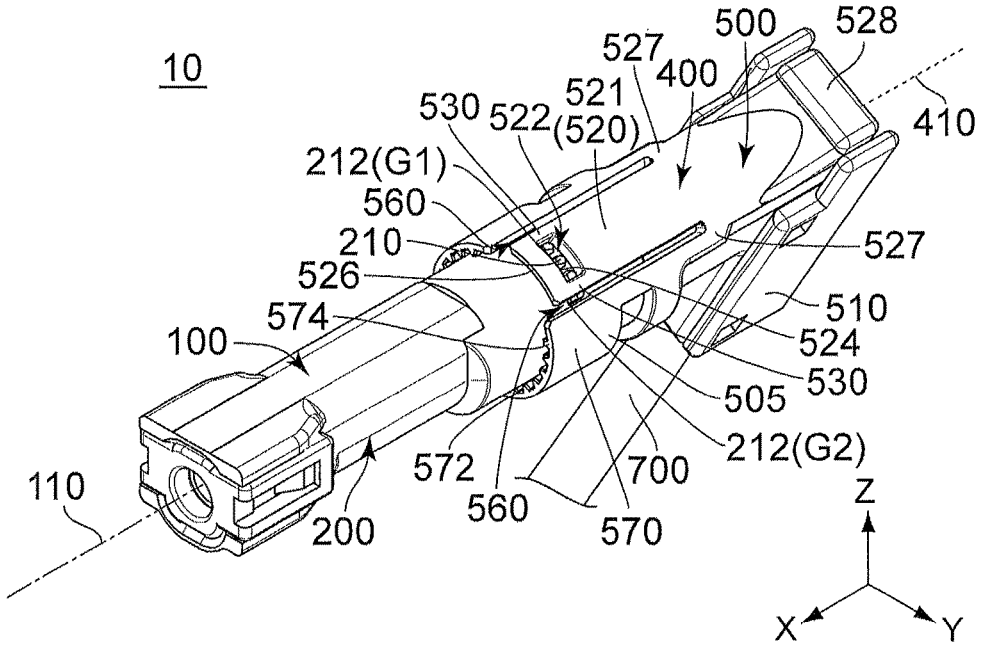
FIG. 4 is another perspective view showing the connector assembly of FIG. 1, wherein a cable extends in a direction different from a direction in which a cable illustrated in FIG. 1 extends.

As understood from FIG. 4, even if the second connector 400 is mated with the first connector 100 in an attitude where the second connector 400 shown in FIG. 8 is rotated relative to the first connector 100 by any angle in the circumferential direction of the second virtual axis 410, the first connector 100 and the second connector 400 are mated with each other in a similar manner as described above. As described above, the first engagement portions 212 of the first connector 100 are arranged at the regular intervals in the circumferential direction of the first virtual axis 110. Accordingly, the second connector 400 can be mated with the first connector 100 in a rotated attitude where the second connector 400 is rotated relative to the first connector 100 by a rotation angle in the circumferential direction of the second virtual axis 410, wherein the rotation angle can be changed in increments corresponding to the regular intervals, respectively, at which the first engagement portions 212 are arranged.

An operation of releasing the mated state of the first connector 100 with the second connector 400 is described in detail hereinafter.

Referring to FIGS. 1 to 9, when the release portion 528 of the support portion 520 of the second connector 400 is operated under the aforementioned mated state, the second engagement portion 524 is moved away from a front space of each of the first engagement portions 212 of the first group G1 so that the second connector 400 is removable from the first connector 100. In detail, when the release portion 528 of the support portion 520 of the second connector 400 is pressed inward in the perpendicular direction under the aforementioned mated state, the recess 522 is moved outward in the perpendicular direction, so that the second engagement portion 524 of the recess 522 of the support portion 520 of the second connector 400 is positioned outward beyond each of the first engagement portions 212 of the first group G1 of the first connector 100 in the perpendicular direction. Specifically, at that time, the second engagement portion 524 of the recess 522 of the support portion 520 of the second connector 400 does not face any of the first engagement portions 212 of the first group G1 of the first connector 100 in the front-rear direction. Accordingly, when the first connector 100 and the second connector 400 are moved away from each other in the front-rear direction in this state, the mated state of the first connector 100 with the second connector 400 can be released.

Second Embodiment

Figure 10:
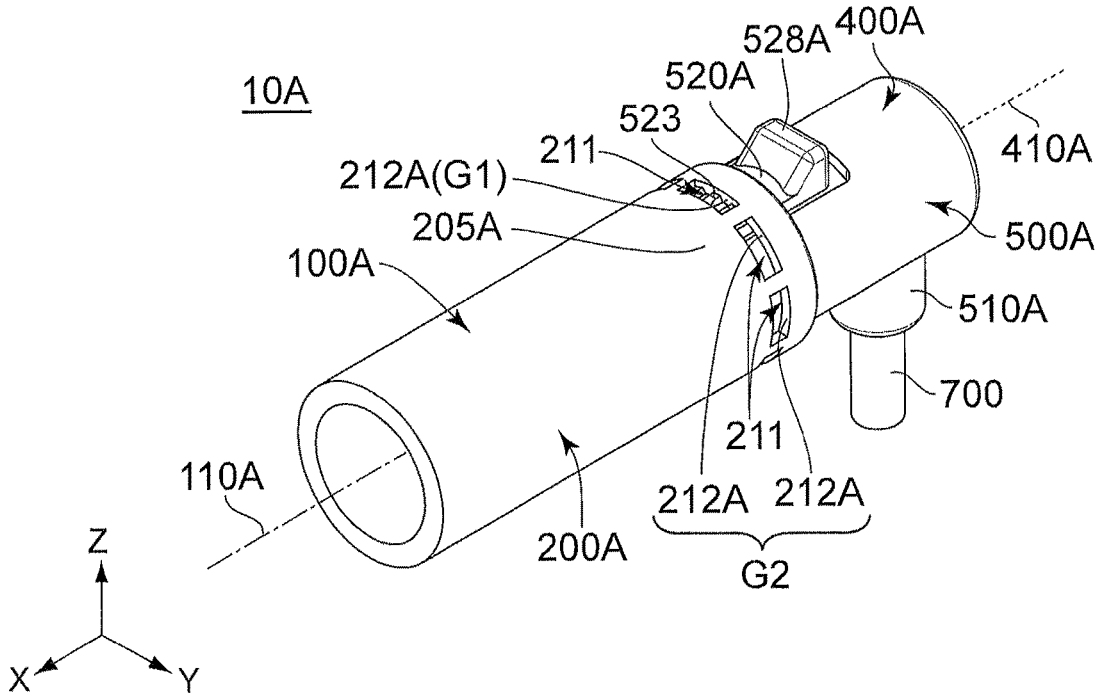
FIG. 10 is a perspective view showing a connector assembly according to a modification, wherein a first connector and a second connector are shown simplified except for an engagement structure.
Figure 11:
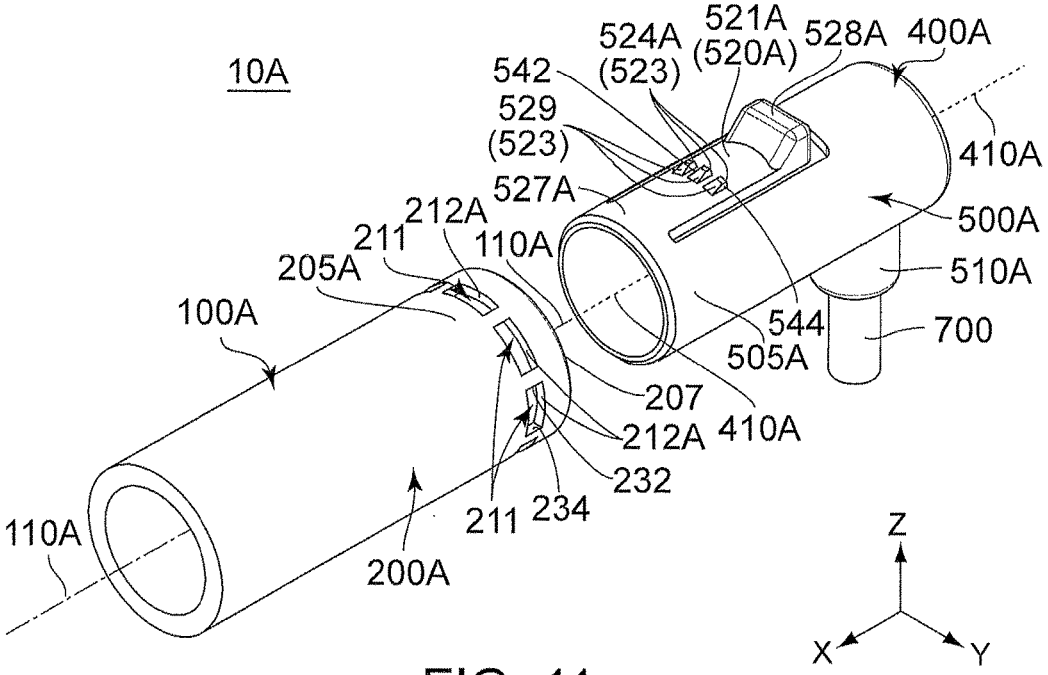
FIG. 11 is a perspective view showing the connector assembly of FIG. 10, wherein the illustrated first connector and the illustrated second connector are not mated with each other.
Figure 12:
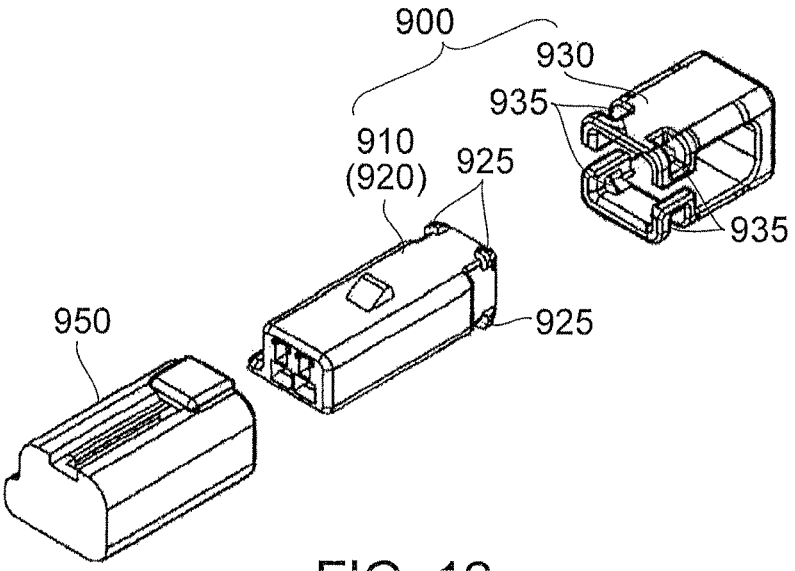
FIG. 12 PRIOR ART
FIG. 12 is a perspective view showing a connector unit and a mating connector of Patent Document 1, wherein the connector unit and the mating connector are not mated with each other, and a cover is not attached to a connector of the connector unit.

As shown in FIGS. 10 and 11, a connector assembly 10A according to a second embodiment of the present invention comprises a first connector 100A and a second connector 400A. The connector assembly 10A of the second embodiment has a structure similar to the structure of the connector assembly 10 of the first embodiment except for an engagement structure. Accordingly, components similar to those of the first embodiment among components of the second embodiment will be designated by the same reference numerals as those of the first embodiment, and detail explanation thereabout will be omitted. As for directions in the present embodiment, expressions same as those of the first embodiment will be used hereinbelow.

As shown in FIGS. 10 and 11, similar to the first connector 100 and the second connector 400 of the first embodiment, the first connector 100A of the present embodiment has a first virtual axis 110A, while the second connector 400A of the present embodiment has a second virtual axis 410A. In the present embodiment, each of the first virtual axis 110A and the second virtual axis 410A is parallel to the front-rear direction. Similar to the first embodiment, the first connector 100A and the second connector 400A of the present embodiment are mateable with each other along the front-rear direction so that the first virtual axis 110A and the second virtual axis 410A are aligned with each other. In the present embodiment, the second connector 400A is a cable connector which is configured to be connected with the cable 700. However, the present invention is not limited thereto. It is sufficient that one of the first connector and the second connector is a cable connector which is configured to be connected with a cable.

As shown in FIGS. 10 and 11, the first connector 100A of the present embodiment comprises a first holding member 200A, a first main terminal (not shown) and a first sub terminal (not shown).

As shown in FIGS. 10 and 11, the first holding member 200A of the present embodiment has a first mating portion 205A and a plurality of first engagement portions 212A. The first mating portion 205A is positioned at a rear end of the first holding member 200A in the front-rear direction. The first mating portion 205A has a substantially cylindrical shape when viewed from a rear of the first holding member 200A. The first mating portion 205A has a rear end 207 in the front-rear direction. A center axis of the substantially cylindrical shape of the first mating portion 205A is aligned with the first virtual axis 110A. An outer circumferential surface of the substantially cylindrical shape of the first mating portion 205A is provided with a plurality of recesses 211. In other words, the first connector 100A of the present embodiment has the plurality of the recesses 211. Each of the recesses 211 pierces the first mating portion 205A in the perpendicular direction perpendicular to the front-rear direction. Specifically, each of the recesses 211 pierces the first mating portion 205A in the radial direction of the first virtual axis 110A. Each of the recesses 211 has a first side wall 232, a second side wall 234 and a rear inner wall 212A. The rear inner wall 212A is positioned rearward of the recess 211. The first side wall 232 and the second side wall 234 are arranged along the circumferential direction of the first virtual axis 110A. Specifically, each of the recesses 211 is partially defined by the rear inner wall 212A. In addition, each of the recesses 211 is also partially defined by each of the first side wall 232 and the second side wall 234. The rear inner wall 212A is a plane perpendicular to the front-rear direction. The rear inner wall 212A faces forward in the front-rear direction. The rear inner walls 212A of the recesses 211 function as the first engagement portions 212A, respectively. The first engagement portions 212A are arranged at regular intervals in the circumferential direction of the first virtual axis 110A.

As shown in FIGS. 10 and 11, the first main terminal (not shown), a first guard portion (not shown) and the first sub terminal (not shown) are provided inside the substantially cylindrical shape of the first mating portion 205A.

As shown in FIGS. 10 and 11, the second connector 400A of the present embodiment is the cable connector. Specifically, the second connector 400A comprises a second holding member 500A, a second main terminal (not shown) and a second sub terminal (not shown).

As shown in FIGS. 10 and 11, the second holding member 500A has a second mating portion 505A, a cable holding portion 510A, a support portion 520A and a plurality of second engagement portions 524A. However, the present invention is not limited thereto. It is sufficient that the second connector comprises at least one support portion and at least one second engagement portion.

As shown in FIGS. 10 and 11, the second mating portion 505A of the present embodiment is positioned at a front end of the second holding member 500A in the front-rear direction. The second mating portion 505A has a cylindrical shape when viewed from a front of the second holding member 500A in the front-rear direction. A second guard portion (not shown), the second main terminal (not shown) and the second sub terminal (not shown) are provided inside the cylindrical shape of the second mating portion 505A.

As shown in FIGS. 10 and 11, the cable holding portion 510A of the present embodiment holds a part of the cable 700 so that the part of the cable 700 extends in a direction different from the front-rear direction. Specifically, in FIGS. 10 and 11, the cable 700 is held by the cable holding portion 510A so as to extend downward in the up-down direction.

As shown in FIGS. 10 and 11, the support portion 520A of the present embodiment is positioned at an upper part of the second holding member 500A in the up-down direction. The support portion 520A of the present embodiment has an arc-shape when viewed from its front in the front-rear direction. The support portion 520A of the present embodiment has a plate-like portion 521A, a fulcrum portion 527A and a release portion 528A.

As shown in FIGS. 10 and 11, the plate-like portion 521A of the present embodiment is resiliently deformable. The plate-like portion 521A has a curved plate-like shape extending in the front-rear direction. The plate-like portion 521A is provided with a plurality of protrusions 523. More specifically, the plate-like portion 521A of the present embodiment is provided with three of the protrusions 523. Each of the protrusions 523 has a first side surface 542, a second side surface 544, a slope 529 and a rear surface 524A. The rear surface 524A faces rearward in the front-rear direction. The first side surface 542 and the second side surface 544 are arranged along the circumferential direction of the second virtual axis 410A. The slope 529 is oblique to both the front-rear direction and the up-down direction. The slope 529 is positioned forward of the rear surface 524A in the front-rear direction. More specifically, the slope 529 of the present embodiment is sloped so that the protrusion 523 is increased in height toward a rear end of the slope 529. The rear surface 524A functions as the second engagement portion 524A. The rear surface 524A is a plane perpendicular to the front-rear direction. The rear surface 524A is positioned at a rear end of the protrusion 523 in the front-rear direction.

As shown in FIGS. 10 and 11, the fulcrum portion 527A of the present embodiment is positioned at a front end of the support portion 520A in the front-rear direction. The fulcrum portion 527A is coupled with the second mating portion 505A. Specifically, the support portion 520A of the present embodiment is coupled with a part of the second holding member 500A, which is other than the support portion 520A, only by the fulcrum portion 527A.

As shown in FIGS. 10 and 11, the release portion 528A of the present embodiment is formed on a rear end of the support portion 520A in the front-rear direction. The release portion 528A protrudes upward in the up-down direction. As described above, the support portion 520A of the present embodiment has the plate-like portion 521A, which is resiliently deformable, and is coupled with the part of the second holding member 500A, which is other than the support portion 520A, only by the fulcrum portion 527A in a cantilever manner. Accordingly, when the release portion 528A is pressed downward, the release portion 528A is moved downward while the second engagement portion 524A of each of the protrusions 523 is moved downward. When the release portion 528A is unpressed, the release portion 528A and the second engagement portion 524A of each of the protrusions 523 return to their initial positions. In other words, the support portion 520A of the present embodiment supports each of the second engagement portions 524A so that each of the second engagement portions 524A is movable in the up-down direction. However, the present invention is not limited thereto. It is sufficient that the support portion supports at least one second engagement portion so that the at least one second engagement portion is movable in a direction intersecting with the front-rear direction.

An operation of mating the first connector 100A with the second connector 400A is described in detail hereinafter.

As shown in FIGS. 10 and 11, in a plane perpendicular to the front-rear direction, the first connector 100A and the second connector 400A are positioned so that the first virtual axis 110A of the first connector 100A and the second virtual axis 410A of the second connector 400A are aligned with each other. Next, the first connector 100A and the second connector 400A are moved to approach each other so that the first mating portion 205A of the first connector 100A and the second mating portion 505A of the second connector 400A are closer to each other in the front-rear direction.

Meanwhile, the slope 529 of each of the three protrusions 523 of the second connector 400A is brought into contact with the rear end 207 of the first mating portion 205A of the first connector 100A, and the fulcrum portion 527A of the support portion 520A is then deformed so that the protrusions 523 are moved inward in the perpendicular direction.

When the first connector 100A and the second connector 400A are further moved to approach each other in the front-rear direction in this state so that each of the second engagement portions 524A of the protrusions 523 reaches a relative position same as that of the first engagement portion 212A of one of the recesses 211 of the first connector 100A in the front-rear direction, the fulcrum portion 527A of the support portion 520A restores its original shape while the protrusions 523 return to their initial positions in the perpendicular direction. In other words, the first connector 100A and the second connector 400A are in a mated state where the first connector 100A and the second connector 400A are mated with each other.

As shown in FIGS. 10 and 11, the first connector 100A is positioned forward of the second connector 400A in the front-rear direction under the aforementioned mated state. In addition, under the aforementioned mated state, one of the first side walls 232 of the recesses 211 faces one of the first side surfaces 542 of the protrusions 523 while one of the second side walls 234 of the recesses 211 faces one of the second side surfaces 544 of the protrusions 523. More specifically, all of the protrusions 523 of the support portion 520A of the second connector 400A are received in the one of the recesses 211 of the first mating portion 205A of the first connector 100A. Since each of the recesses 211 of the present embodiment pierces the first mating portion 205A in the radial direction of the first virtual axis 110A, an engagement state of the first engagement portion 212A with the second engagement portions 524A can be visually inspected. However, the present embodiment is not limited thereto. It is sufficient that each of the protrusions is, at least in part, received in one of the recesses.

As understood from FIGS. 10 and 11, under the aforementioned mated state, the first engagement portions 212A are divided into a first group G1 and a second group G2. Specifically, each of the second engagement portions 524A faces one of the first engagement portions 212A of the first group G1 in the front-rear direction while each of the first engagement portions 212A of the second group G2 does not face any of the second engagement portions 524A in the front-rear direction. In detail, under the aforementioned mated state, the first engagement portions 212A are divided into the first group G1, which includes the first engagement portion 212A of the recess 211 receiving the protrusions 523, and the second group G2 which includes the first engagement portions 212A of the recesses 211 each receiving none of the protrusions 523. Specifically, under the aforementioned mated state, each of the second engagement portions 524A faces the first engagement portion 212A of the first group G1 in the front-rear direction while each of the first engagement portions 212A of the second group G2 does not face any of the second engagement portions 524A in the front-rear direction.

As understood from FIGS. 1, 4, 10 and 11, even if the second connector 400A is mated with the first connector 100A in an attitude where the second connector 400A shown in FIG. 11 is rotated relative to the first connector 100A by any angle in the circumferential direction of the second virtual axis 410A, the first connector 100A and the second connector 400A are mated with each other in a similar manner as described above. As described above, the first engagement portions 212A of the first connector 100A are arranged at the regular intervals in the circumferential direction of the first virtual axis 110A. Accordingly, the second connector 400A can be mated with the first connector 100A in a rotated attitude where the second connector 400A is rotated relative to the first connector 100A by a rotation angle in the circumferential direction of the second virtual axis 410A, wherein the rotation angle can be changed in increments corresponding to the regular intervals, respectively, at which the first engagement portions 212A are arranged.

An operation of releasing the mated state of the first connector 100A with the second connector 400A is described in detail hereinafter.

Referring to FIGS. 10 and 11, when the release portion 528A of the support portion 520A of the second connector 400A is operated under the aforementioned mated state, each of the second engagement portions 524A is moved away from a front space of the first engagement portion 212A of the first group G1 so that the second connector 400A is removable from the first connector 100A. In detail, when the release portion 528A of the support portion 520A of the second connector 400A is pressed inward in the perpendicular direction under the aforementioned mated state, each of the protrusions 523 is moved inward in the perpendicular direction, so that the second engagement portion 524A of each of the protrusions 523 of the support portion 520A of the second connector 400A is positioned inward beyond the first engagement portion 212A of the first group G1 of the first connector 100A in the perpendicular direction. Specifically, at that time, the second engagement portion 524A of each of the protrusions 523 of the support portion 520A of the second connector 400A does not face the first engagement portion 212A of the first group G1 of the first connector 100A in the front-rear direction. Accordingly, when the first connector 100A and the second connector 400A are moved away from each other in the front-rear direction in this state, the mated state of the first connector 100A with the second connector 400A can be released.

Although the specific explanation about the present invention is made above referring to the embodiments, the present invention is not limited thereto and is susceptible to various modifications and alternative forms.

Although, in the first embodiment, the recess 522 of the second connector 400 receives the remaining three protrusions 210 of the first connector 100 under the mated state, the present invention is not limited thereto. The recess of the second connector may, at least in part, receive at least one of the protrusions of the first connector. However, since the recess 522 of the present embodiment is formed to have a size greater than a size of the protrusion 210 so as to receive the remaining three protrusions 210, the recess 522 itself can be easily formed while the support portion 520 provided with the recess 522 has an increased width in the circumferential direction of the second virtual axis 410 so that strength of the support portion 520 is easily ensured. Accordingly, the recess 522 of the present embodiment is preferred.

Although, in the first embodiment, the recess 522 of the second connector 400 pierces the support portion 520 in the radial direction of the second virtual axis 410, the present invention is not limited thereto. The recess 522 may be a bottomed recess which is recessed outward in the radial direction of the second virtual axis 410. Additionally, although, in the second embodiment, each of the recesses 211 of the first connector 100A pierces the first mating portion 205A in the radial direction of the first virtual axis 110A, the present invention is not limited thereto. The recess 211 may be a bottomed recess which is recessed outward in the radial direction of the first virtual axis 110A. However, since the recess 522 of the present embodiment pierces the support portion 520 in the radial direction of the second virtual axis 410, the engagement state of the first engagement portions 212 with the second engagement portion 524 can be easily inspected upon the mating of the first connector 100 with the second connector 400 and the recess 522 can be easily formed. Accordingly, the recess 522 of the present embodiment is preferred. Similarly, since each of the recesses 211 of the present embodiment pierces the first mating portion 205A in the radial direction of the first virtual axis 110A, the engagement state of the first engagement portion 212A with the second engagement portions 524A can be easily inspected upon the mating of the first connector 100A with the second connector 400A and each of the recesses 211 can be easily formed. Accordingly, each of the recesses 211 of the present embodiment is preferred.

As shown in FIG. 10, in the second embodiment, all of the three protrusions 523 of the plate-like portion 521A of the support portion 520A of the second connector 400A are received in the one of the recesses 211 of the first connector 100A under the mated state where the first connector 100A and the second connector 400A are mated with each other. However, the present invention is not limited thereto. Under the mated state where the first connector 100A and the second connector 400A are mated with each other, one of the three protrusions 523 of the plate-like portion 521A of the support portion 520A of the second connector 400A may be received in one of the recesses 211 of the first connector 100A while a remaining two of the three protrusions 523 of the plate-like portion 521A of the support portion 520A of the second connector 400A may be received in the recess 211 which is adjacent to the one of the recesses 211 of the first connector 100A in the circumferential direction of the first virtual axis 110A.

Although the first holding member 200, 200A of the first connector 100, 100A is provided with the first engagement portions 212, 212A while the second holding member 500, 500A of the second connector 400, 400A is provided with the second engagement portion(s) 524, 524A, the present invention is not limited thereto. For example, if the first holding member of the first connector is provided with an outer housing or a shell, the outer housing or the shell may be provided with the first engagement portions. Similarly, if the second holding member of the second connector is provided with an outer housing or a shell, the outer housing or the shell may be provided with the second engagement portion(s).

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, wherein:
- the first connector has a first virtual axis;
- the second connector has a second virtual axis;
- the first connector and the second connector are mateable with each other along a front-rear direction so that the first virtual axis and the second virtual axis are aligned with each other;
- one of the first connector and the second connector is a cable connector which is configured to be connected with a cable;
- the cable connector has a cable holding portion which holds a part of the cable so that the part of the cable extends in a direction different from the front-rear direction;
- the first connector comprises a plurality of first engagement portions;
- the second connector comprises at least one support portion and at least one second engagement portion;
- the support portion supports the at least one second engagement portion so that the at least one second engagement portion is movable in a direction intersecting with the front-rear direction; and
- under a mated state where the first connector and the second connector are mated with each other, the first engagement portions are divided into to a first group and a second group and each of the at least one second engagement portion faces one of the first engagement portion(s) of the first group in the front-rear direction while each of the first engagement portion(s) of the second group does not face any of the at least one second engagement portion in the front-rear direction.

2. The connector assembly as recited in claim 1, wherein the first engagement portions are arranged at regular intervals in a radial direction of the first virtual axis.

3. The connector assembly as recited in claim 1, wherein:
- the support portion has a release portion; and
- when the release portions is operated under the mated state, the second engagement portion is moved away from a front space of each of the first engagement portion(s) of the first group so that the second connector is removable from the first connector.

4. The connector assembly as recited in claim 1, wherein:
- the first connector is positioned forward of the second connector in the front-rear direction under the mated state;
- the first connector has a plurality of recesses;
- the second connector has a plurality of protrusions;
- under the mated state, each of the protrusions is, at least in part, received in one of the recesses;
- each of the recesses has a rear inner wall;
- each of the recesses is partially defined by the rear inner wall;
- the rear inner wall faces forward in the front-rear direction;
- the rear inner wall functions as the first engagement portion;
- each of the protrusions has a rear surface facing rearward in the front-rear direction; and
- the rear surface functions as the second engagement portion.

5. The connector assembly as recited in claim 4, wherein:
- each of the recesses has a first side wall and a second side wall;
- the first side wall and the second side wall are arranged in a circumferential direction of the first virtual axis;
- each of the recesses is partially defined by the first side wall and the second side wall;
- each of the protrusions has a first side surface and a second side surface;
- the first side surface and the second side surface are arranged in a circumferential direction of the second virtual axis; and
- under the mated state, one of the first side walls of the recesses faces one of the first side surfaces of the protrusions while one of the second side walls of the recesses faces one of the second side surfaces of the protrusions.

6. The connector assembly as recited in claim 1, wherein:
- the first connector is positioned forward of the second connector in the front-rear direction under the mated state;
- the first connector has a plurality of protrusions;
- each of the protrusions has a front surface facing forward in the front-rear direction;
- the front surface of the protrusion functions as the first engagement portion;
- the second connector has at least one recess;
- under the mated state, the recess, at least in part, receives at least one of the protrusions;
- the recess has a front inner wall;
- the recess is partially defined by the front inner wall;
- the front inner wall faces rearward in the front-rear direction; and
- the front inner wall of the recess functions as the second engagement portion.

7. The connector assembly as recited in claim 6, wherein the recess pierces the support portion in a radial direction of the second virtual axis.

8. The connector assembly as recited in claim 6, wherein one of the at least one second engagement portion faces a plurality of the first engagement portions in the front-rear direction under the mated state.

9. The connector assembly as recited in claim 6, wherein:
- the second connector has at least two slits and a cover portion;
- each of the slits extends in the front-rear direction; and each of the slits is interposed between the cover portion and the support portion in a circumferential direction of the second virtual axis.

10. The connector assembly as recited in claim 9, wherein:

the support portion has a beam portion which is positioned between each of the slits and the recess in the circumferential direction of the second virtual axis; and under the mated state, the beam portion is, at least in part, positioned between two of the protrusions while the beam portion does not ride over the protrusions, the two of the protrusions being adjacent to each other in a circumferential direction of the first virtual axis.

11. The connector assembly as recited in claim 9, wherein:

the front surface(s) of one(s) of the protrusions function as the first engagement portion(s) of the second group; and at least one of the one(s) of the protrusions faces the cover portion in a radial direction of the first virtual axis under the mated state.

12. The connector assembly as recited in claim 11, wherein:

the cover portion is formed with at least one ditch extending in the front-rear direction; and at least a part of the first engagement portion of the second group is accommodated in the ditch.

13. The connector assembly as recited in claim 12, wherein:

the cover portion has a front end in the front-rear direction;

the ditch extends to reach the front end of the cover portion in the front-rear direction;

the support portion has a front end in the front-rear direction; and the front end of the cover portion is positioned forward of the front end of the support portion in the front-rear direction.

* * * * *